US007478919B2

(12) United States Patent
Izardel

(10) Patent No.: US 7,478,919 B2
(45) Date of Patent: Jan. 20, 2009

(54) LAMP STRIP ASSEMBLY

(75) Inventor: Lazar Izardel, Tel Aviv (IL)

(73) Assignee: Gamasonic Ltd., Tel Aviv (IL)

( * ) Notice: Subject to any disclaimer, the term of this patent is extended or adjusted under 35 U.S.C. 154(b) by 25 days.

(21) Appl. No.: 11/084,156

(22) Filed: Mar. 21, 2005

(65) Prior Publication Data

US 2006/0209540 A1 Sep. 21, 2006

(51) Int. Cl.
*F21S 4/00* (2006.01)

(52) U.S. Cl. ..... 362/225; 362/247; 362/237; 362/299; 362/300

(58) Field of Classification Search ..... 362/225, 362/222, 223, 241, 243, 245, 297, 299, 300, 362/183, 247, 237, 217
See application file for complete search history.

(56) References Cited

U.S. PATENT DOCUMENTS 733,670 A * 7/1903 Merritt ..... 362/296
3,772,509 A * 11/1973 Hirota ..... 362/30
4,816,970 A * 3/1989 Garcia, Jr. ..... 362/183
5,060,125 A * 10/1991 Cowie et al. ..... 362/218
7,114,834 B2 * 10/2006 Rivas et al. ..... 362/373
7,182,480 B2 * 2/2007 Kan ..... 362/242
2004/0042209 A1 * 3/2004 Wehner et al. ..... 362/247

FOREIGN PATENT DOCUMENTS

JP 59011934 A * 1/1984

* cited by examiner

*Primary Examiner*—Sharon E Payne
(74) *Attorney, Agent, or Firm*—Dekel Patent Ltd.; David Klein

(57) ABSTRACT

A lamp strip assembly including a lamp and an elongate reflector, forming a lamp set, mounted in an elongate housing, the elongate reflector including a curved reflective portion at one end thereof and the lamp being distanced axially away from that end, wherein the curved reflective portion is adapted to reflect light rays from the lamp through a light transmissive element of the elongate housing.

11 Claims, 2 Drawing Sheets

LAMP STRIP ASSEMBLY

FIELD OF THE INVENTION

The present invention relates generally to lights for illumination, and particularly to a lamp strip assembly having lights and light reflectors.

BACKGROUND OF THE INVENTION

There are many kinds of lamps and illumination devices. Lights are known that employ some device, such as a lampshade or a reflector, to direct light rays outwards in a desired direction.

SUMMARY OF THE INVENTION

The present invention seeks to provide a novel lamp strip assembly, as is described more in detail hereinbelow. The lamp strip assembly may be used for indoor and outdoor lighting and may be mounted on objects for illuminating them (e.g., on the underside of umbrellas or canopies).

There is thus provided in accordance with an embodiment of the present invention a lamp strip assembly including a lamp and an elongate reflector, forming a lamp set, mounted in an elongate housing, the elongate reflector including a curved reflective portion at one end thereof and the lamp being distanced axially away from that end, wherein the curved reflective portion is adapted to reflect light rays from the lamp through a light transmissive element of the elongate housing. A plurality of the lamp sets may be mounted axially one after another in the elongate housing.

In accordance with an embodiment of the present invention the lamp may be positioned outwards from an end of the elongate reflector opposite to the end where the curved reflective portion is located.

Further in accordance with an embodiment of the present invention the lamp of one of the lamp sets may be mounted underneath the curved reflective portion of an adjacent elongate reflector of an adjacent lamp set.

The curved reflective portion may be curved concavely with respect to the light rays impinging thereon. The curved reflective portion may be parabolically curved, and may be white.

BRIEF DESCRIPTION OF THE DRAWINGS

The present invention will be understood and appreciated more fully from the following detailed description taken in conjunction with the drawings in which:

FIGS. 4-6 are simplified pictorial illustrations of a light and reflector of the lamp strips of FIG. 1, wherein FIGS. 4, 5 and 6 show different lengths of the elongate reflectors and different mounting configurations of the lamps with respect to the elongate reflectors.

DETAILED DESCRIPTION OF EMBODIMENTS

Figure 2:
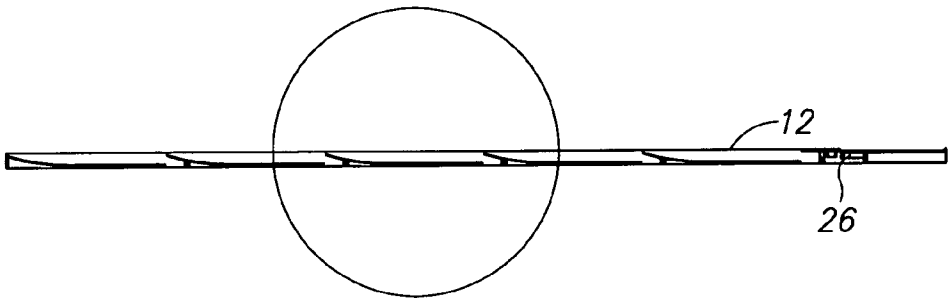
FIGS. 2 and 3 are simplified pictorial illustrations showing inner components of the lamp strips of FIG. 1.
Figure 3:
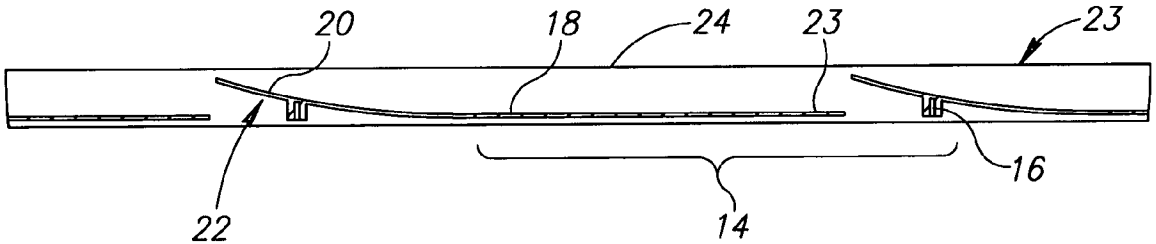
Figure 1:
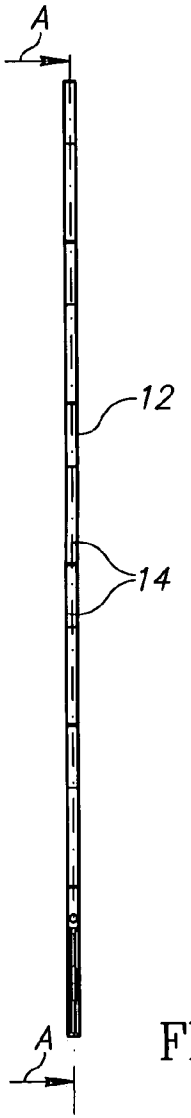
FIG. 1 is a simplified pictorial illustration of a lamp strip assembly comprising as plurality of lamp strips, constructed and operative in accordance with an embodiment of the present invention.
Figure 4:
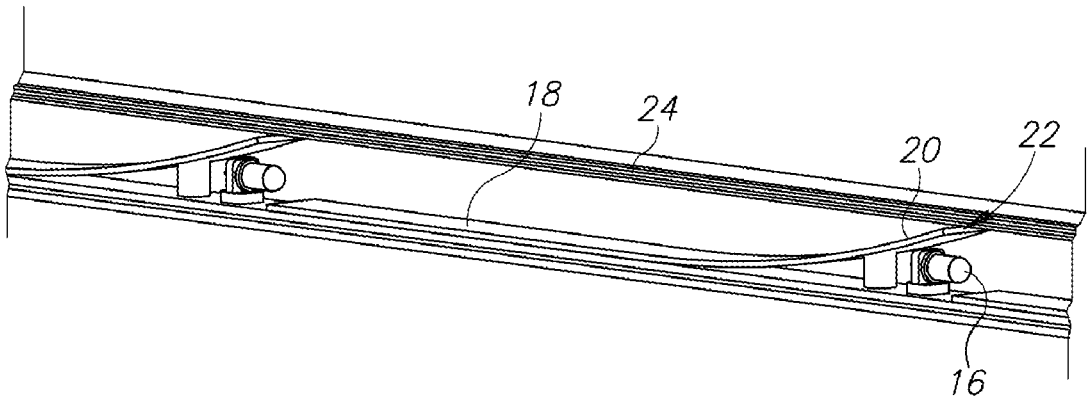
Figure 5:
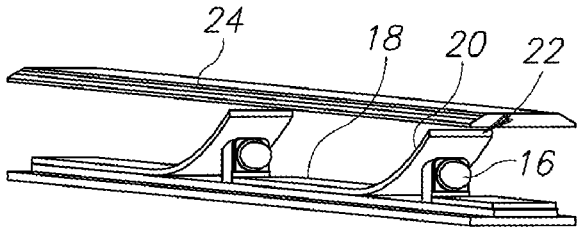
Figure 6:
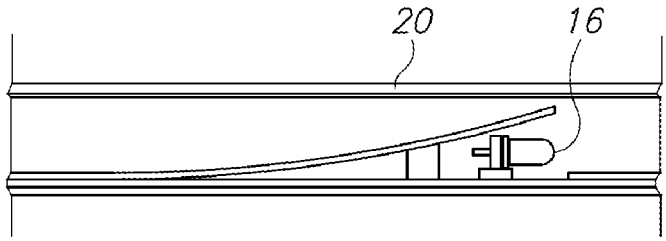

Reference is now made to FIGS. 1-6, which illustrate a lamp strip assembly 10, constructed and operative in accordance with an embodiment of the present invention.

Lamp strip assembly 10 may include an elongate housing 12 in which one or more lamp sets 14 may be mounted. ("Elongate" means having a length longer than the width, preferably but not necessarily at least twice as long than the width.) Each lamp set 14 includes a lamp 16 and an elongate reflector 18. The elongate reflector 18 may include a curved reflective portion 20 at an end 22 thereof. Lamp 16 is distanced axially away from end 22. For example, without limitation, lamp 16 may be positioned outwards from an end 23 of the elongate reflector 18 opposite to end 22.

The curved reflective portion 20 is adapted to reflect light rays from lamp 16 through a light transmissive element 24 of elongate housing 12. The light transmissive element 24 may be transparent or translucent (or anything between), and may have any size and color.

The curved reflective portion 20 may be white and concavely curved with respect to lamp 16. "White" is defined as the color that has no or little hue, due to the reflection of all or almost all incident light. "White" in the specification and claims encompasses, bright white, "dirty" white, off-white, gray-white, snow white, hard-boiled-egg white and other shades of white. The curved reflective portion 20 may be, without limitation, a parabolic curve or a tulip-shaped curve, for example.

In the illustrated embodiment, there are more than one sets 14 of the lamps 16 and elongate reflectors 18 mounted axially one after another in the elongate housing 12. The lamp 16 of one of the lamp sets 14 may be mounted underneath the curved reflective portion 20 of an adjacent elongate reflector 18 of an adjacent lamp set 14.

The elongate housing 12 may have any cross-sectional shape and size, and may be constructed of any suitable material, such as but not limited to, metal (e.g., stainless steel, aluminum or others) or plastic (e.g., polycarbonate or other plastics).

The lamps 16 may be powered by an electrical power source 26 (FIG. 2), such as but not limited to, a battery or a solar cell/solar collector. The lamps 16 may comprise, without limitation, LEDs or incandescent lights, and may have any size and color.

It will be appreciated by persons skilled in the art that the present invention is not limited by what has been particularly shown and described hereinabove. Rather the scope of the present invention includes both combinations and subcombinations of the features described hereinabove as well as modifications and variations thereof which would occur to a person of skill in the art upon reading the foregoing description and which are not in the prior art.

What is claimed is:

1. A lamp strip assembly comprising:

a lamp and an elongate reflector, forming a lamp set, mounted in an elongate housing, said elongate reflector comprising a curved reflective portion at one end thereof and said lamp being distanced away from that end along an elongate axis of said elongate housing, wherein said curved reflective portion is adapted to reflect light rays, which are directed from said lamp along said elongate axis towards said curved reflective portion, through a light transmissive element of said elongate housing, and wherein a plurality of the lamp sets are mounted axially one after another in the elongate housing and wherein the elongate reflectors of each of the lamp sets are discrete and separated from each other, and wherein said elongate housing is the only common mounting surface for said lamp and said elongate reflector of each said lamp set, and wherein the curved reflective portion is curved concavely with respect to the light rays impinging thereon, and wherein the lamp of one of the lamp sets, called a first lamp, is mounted underneath the curved reflective portion of an adjacent elongate reflector of an adjacent lamp set, wherein said adjacent elongate reflector blocks light rays from said first lamp from passing unreflected through said light transmissive element and light rays from said first lamp pass through said light transmissive element only by reflection from the elongate reflector belonging to the lamp set of said first lamp.

2. The lamp strip assembly according to claim 1, wherein none of said lamps touch any of said elongate reflectors.

3. The lamp strip assembly according to claim 1, wherein the lamp is positioned outwards from an end of the elongate reflector opposite to the end where the curved reflective portion is located.

4. The lamp strip assembly according to claim 1, wherein said curved reflective portion is curved with respect to said first lamp so that light rays reflected from said elongate reflector belonging to the lamp set of said first lamp rays are not directed back over said first lamp.

5. The lamp strip assembly according to claim 1, wherein the lamp is powered by a battery.

6. The lamp strip assembly according to claim 1, wherein the lamp is powered by a solar cell.

7. The lamp strip assembly according to claim 1, wherein the curved reflective portion is parabolically curved.

8. The lamp strip assembly according to claim 1, wherein the curved reflective portion is white.

9. The lamp strip assembly according to claim 1, wherein said light transmissive element has a light transmission in a range from transparent to translucent.

10. The lamp strip assembly according to claim 1, further comprising a support stub underneath and attached to the curved reflective portion of said elongate reflector and attached to said elongate housing and spaced from said lamp.

11. The lamp strip assembly according to claim 4, further comprising a support stub underneath and attached to the curved reflective portion of said elongate reflector and attached to said elongate housing and spaced from said lamp, and wherein the lamp of one of the lamp sets is mounted underneath the curved reflective portion of an adjacent elongate reflector of an adjacent lamp set and next to said support stub.

* * * * *